US008616768B2

(12) United States Patent
Inagaki et al.

(10) Patent No.: US 8,616,768 B2
(45) Date of Patent: Dec. 31, 2013

(54) PLEATED STAND-UP PACKAGING POUCH, PLEATED STAND-UP PACKAGING BODY, FEED ROLL FOR PLEATED STAND-UP PACKAGING BODY, AND METHOD OF MANUFACTURING PLEATED STAND-UP PACKAGING BODY

(75) Inventors: Hiromichi Inagaki, Inuyama (JP); Sakaru Takahashi, Tokyo (JP)

(73) Assignee: Chokoku Plast Corporation, Osaka-shi, Osaka (JP)

( * ) Notice: Subject to any disclaimer, the term of this patent is extended or adjusted under 35 U.S.C. 154(b) by 793 days.

(21) Appl. No.: 12/312,131

(22) PCT Filed: Oct. 26, 2007

(86) PCT No.: PCT/JP2007/070926

§ 371 (c)(1),
(2), (4) Date: Apr. 24, 2009

(87) PCT Pub. No.: WO2008/050865

PCT Pub. Date: May 2, 2008

(65) Prior Publication Data

US 2010/0061665 A1 Mar. 11, 2010

(30) Foreign Application Priority Data

Oct. 27, 2006 (JP) ..... 2006-293187

(51) Int. Cl.
*B65D 30/16* (2006.01)
*B65D 30/20* (2006.01)

(52) U.S. Cl.
USPC ..... 383/120; 383/123; 383/125; 383/126; 53/450; 53/451; 53/550; 53/551

(58) Field of Classification Search
USPC ..... 383/120, 121.1, 123, 125, 126; 156/196, 204, 211, 218, 250, 251, 256, 156/258, 269, 292; 53/450, 451, 550, 551; 493/218
See application file for complete search history.

(56) References Cited

U.S. PATENT DOCUMENTS 2,070,747 A * 2/1937 Orstrom ..... 229/104
3,935,993 A * 2/1976 Doyen et al. ..... 383/94

(Continued)

FOREIGN PATENT DOCUMENTS

JP 2001-158437 6/2001
JP 2003-191963 7/2003

(Continued)

OTHER PUBLICATIONS

Japanese Office Action dated Jun. 29, 2012, including English parts cited as relevant to the claims and machine translations obtained from the JPO website.

*Primary Examiner* — Hemant M Desai
*Assistant Examiner* — Gloria R Weeks
(74) *Attorney, Agent, or Firm* — Flynn, Thiel, Boutell & Tanis, P.C.

(57) ABSTRACT

A pleated stand-up packaging pouch has a rib in a pinch form which is formed by adhering inner faces of end edges of the packaging material and at least one pleat which is formed by folding the pleated stand-up packaging material in a three-ply strip form in the orthogonal direction to its longitudinal direction and adhering inner faces of the folded portions, and is characterized in that the pleat formed on an edge between a folded bottom face portion and a peripheral portion extends from the peripheral portion in the same plane as the peripheral portion, and the bottom face portion and an upper end of an underside face of the pleat form a substantially right angle, and the pleat has a cut-off portion at the portion where the pleat and the rib cross.

11 Claims, 10 Drawing Sheets

(56) References Cited

U.S. PATENT DOCUMENTS

| | | | | | |
|---|---|---|---|---|---|
| 4,055,109 | A | * | 10/1977 | Kan | 493/196 |
| 4,704,845 | A | * | 11/1987 | Bruno | 53/482 |
| 5,031,380 | A | * | 7/1991 | Ueda | 53/135.1 |
| 5,062,717 | A | * | 11/1991 | Shockley | 383/20 |
| 5,236,531 | A | * | 8/1993 | Yokoyama | 156/227 |
| 5,313,766 | A | * | 5/1994 | Rimondi et al. | 53/451 |
| 5,398,486 | A | * | 3/1995 | Kauss et al. | 53/551 |
| 5,437,406 | A | * | 8/1995 | Gordon et al. | 229/193 |
| 5,473,866 | A | * | 12/1995 | Maglecic et al. | 53/511 |
| 5,498,080 | A | * | 3/1996 | Dalea et al. | 383/120 |
| 5,852,919 | A | * | 12/1998 | Matsuda et al. | 53/551 |
| 5,930,983 | A | * | 8/1999 | Terminella et al. | 53/436 |
| 6,074,506 | A | * | 6/2000 | Herring et al. | 156/196 |
| 6,085,491 | A | * | 7/2000 | Bois | 53/412 |
| 6,126,315 | A | * | 10/2000 | Ichikawa et al. | 383/43 |
| 6,145,282 | A | * | 11/2000 | Tsuruta | 53/551 |
| 6,481,561 | B2 | * | 11/2002 | Yamamoto et al. | 198/461.1 |
| 6,561,963 | B2 | * | 5/2003 | Totani | 493/218 |
| 6,643,997 | B1 | * | 11/2003 | Schwenke et al. | 53/482 |
| 6,895,729 | B2 | * | 5/2005 | Post et al. | 53/451 |
| 7,065,937 | B2 | * | 6/2006 | Tankersley | 53/411 |
| 7,156,556 | B2 | * | 1/2007 | Takahashi et al. | 383/104 |
| 7,254,930 | B2 | * | 8/2007 | Bartel et al. | 53/450 |
| 7,331,917 | B2 | * | 2/2008 | Totani | 493/244 |
| 7,448,188 | B2 | * | 11/2008 | Hauers et al. | 53/551 |
| D608,656 | S | * | 1/2010 | Wilkes et al. | D9/434 |
| 2005/0069230 | A1 | * | 3/2005 | Takahashi et al. | 383/104 |
| 2006/0107619 | A1 | * | 5/2006 | Reaves et al. | 53/451 |
| 2009/0232424 | A1 | * | 9/2009 | Bierschenk et al. | 383/104 |
| 2011/0019943 | A1 | * | 1/2011 | Piraneo | 383/104 |

FOREIGN PATENT DOCUMENTS

| | | |
|---|---|---|
| JP | 2003-211564 | 7/2003 |
| JP | 2003-231189 | 8/2003 |
| JP | 2003-261105 | 9/2003 |
| JP | 2005-313922 | 11/2005 |
| WO | WO 2006/106932 | 10/2006 |

* cited by examiner

PLEATED STAND-UP PACKAGING POUCH, PLEATED STAND-UP PACKAGING BODY, FEED ROLL FOR PLEATED STAND-UP PACKAGING BODY, AND METHOD OF MANUFACTURING PLEATED STAND-UP PACKAGING BODY

The present invention relates to a pleated stand-up packaging pouch, a pleated stand-up packaging body, a feed roll for the pleated stand-up packaging body, and a method of manufacturing the pleated stand-up packaging body whose technical feature lies in a structure of a pleated stand-up packaging material which can be stably stood up and exhibits a good aesthetic appearance.

BACKGROUND OF THE INVENTION

Conventionally, the stand-up packaging pouch which includes a rib in a pinch form formed by adhering inner faces of end edges of a packaging material and on which at least one pleat extends in the direction orthogonal to its longitudinal direction has been used. In the conventional stand-up packaging pouch, edges are formed between a folded bottom portion and front, rear, and side face portions, and the pleat extends in the same plane as the front, rear, and side faces (refer to the patent publication 1).

Further, in the conventional stand-up packaging pouch, the pleat is formed at its lower end by folding it in a three-ply strip form and applying a heat seal to the folded inner faces to conceal its bottom face portion. This causes the hermetical pleat with no wrinkles to be obtained.

However, as shown in FIG. 10, in the packaging material which includes a rib in a pinch form formed by adhering inner faces of its end edges, there was a technical problem that it is difficult to apply a heat seal to a cross portion between the rib and the pleat which is positioned orthogonal thereto and to sharply bend the cross section. In FIG. 10(*a*), the rib 71 is formed in a pinch form by adhering inner faces of end edges of the packaging material 70. In addition, at least one pleat 72 is formed by folding the packaging material 70 in a three-ply strip form in the direction orthogonal to its longitudinal direction and adhering the folded inner portions. As shown in FIGS. 10(*a*) and 10(*b*), the rib 71 is inclined in one direction. The portion 73 where the rib 71 and the pleat 72 cross is formed. As shown in FIG. 10(*c*), the cross portion 73 is positioned to be edges between a bottom face portion and an outer peripheral portion in a case where the packaging material 70 is folded in order to form the bottom face portion on its lower end. FIG. 10(*c*) shows a situation in which the plane packaging pouch is formed into a packaging body in a three dimensional form.

There are two technical problems with respect to the packaging body in FIG. 10(*c*).

Firstly, the heat seal can be imperfect due to the crossed rib. Such technical problem is explained with reference to FIG. 11 (*b*). FIG. 11 (*b*) shows a cross section at the cross portion 73 where the rib 71 and the pleat 72 cross, more specifically, a cross section along with X(b)-X(b) in FIG. 10(*c*). The reference numbers 72*a* to 72*f* indicate pleats, and the inner faces of the pleats 72*a* and 72*b*, the inner faces of the pleats 72*c* and 72*d*, and the inner faces of the pleats 72*e* and 72*f*, are heat sealed, respectively. The inner faces of the rib 71*a* and 71*b* are heat sealed in a pinch form to form a rib. In a case where the end edges of the packaging material are heat sealed in a pinch form after the pleat is formed by the heat seal, the side of the rib 71*a* are heat sealed from above the pleats 72*a* and 72*b*, while the side of the rib 71*b* are heat sealed from above the pleats 72*c* and 72*d*. In general, the heat seal is applied in such a way that an outer face of the packaging material is pressed by a heated heat sealer. In a case where the ribs 71*a* and 71*b* are heat sealed, the pleats 72*a* and 72*b*, and the pleats 72*c* and 72*d* are positioned so as to sandwich the ribs 71*a* and 71*b* in a pinch form, whereby the heat transmission from the heat sealer to the ribs 71*a* and 71*b* can be blocked. If the heat seal is applied in such a situation, the heat seal can be imperfect due to the fact that the heat transmission from the heat sealer only to the cross portion 73 where the rib 71 and the pleat 72 cross can be insufficient.

Secondly, the lower end of the packaging material 70 is bent in order to form the bottom face portion and the pleat is positioned to be the edge between the bottom face portion and the outer peripheral portion. The rib is formed by substantially laminating a plurality sheets of the packaging material, since the pleats where two sheets of the packaging material are substantially laminated are adhered in a pinch form at the bent portion. In a case where the bottom of the packaging material is formed, it is necessary to fold the rib at a substantially right angle. In such a case, seven sheets of the packaging material are laminated at the bent portion, since the rib is bent in either right or left direction to be inclined. As shown in FIG. 11(*b*) showing the cross section of the bent portion, the seven sheets 71*a*, 71*b*, 72*c*,72*d*,72*e*,72*f*, and 74 of the packaging material are folded. More specifically, the ribs 71*a* and 71*b* press the pleats 72*c*, 72*d*, 72*e* and 72*f* from outside (FIG. 11(*b*)), so that the pleats 72*c*,72*d*,72*e* and 72*f* are forced to be curved, and as a result, a stability and an aesthetic appearance are worsened.

The patent publication: Japanese Patent Laid-open Publication 2003-191963

DISCLOSURE OF THE INVENTION

Problems to be Solved

The object of the present invention is to provide a pleated stand-up packaging material which is capable of improving a heat seal property at a cross portion of its lower end where a rib and a pleat cross at a right angle. Another object of the present invention is to provide a pleated stand-up packaging material which is capable of improving its stability and aesthetic appearance when it is stood up, by sharply bending the cross section.

SUMMARY OF THE INVENTION

The inventor invented the following configurations in order to alleviate an interference of a cross portion where the rib and the pleat of the pleated stand-up packaging material cross, in view of the above technical problems of the conventional pleated stand-up packaging material.

According to a embodiment of the present invention, there is provided a pleated stand-up packaging pouch comprising a rib in a pinch form which is formed by adhering inner faces of end edges of the packaging material, and at least one pleat which is formed by folding the packaging material in a three-ply strip form in the orthogonal direction to its longitudinal direction and adhering inner faces of the folded portions, characterized in that the pleat formed on an edge between a folded bottom face portion and a peripheral portion extends from the peripheral portion in the same plane as the peripheral portion, and the bottom face portion and an upper end of an underside face of the pleat form a substantially right angle, and the pleat comprises a cut-off portion at the portion where the pleat and the rib cross.

According to a preferred configuration, the width of the cut-off portion is equal to, or wider than two times of the width of the rib.

According to a preferred configuration, the width of the cut-off portion is equal to, or wider than three times of the width of the rib.

According to a preferred configuration, a pleated stand-up packaging body which is formed by adhering an opening through which a product to be packaged is introduced into the pleated stand-up packaging pouch.

According to an embodiment of the present invention, there is provided a feed roll for a pleated stand-up packaging body, at least one surface of the feed roll has a heat seal property, and a pleat is formed on a surface opposite to the surface having the heat seal property by folding the feed roll in a three-ply strip form in the orthogonal direction to the direction in which the feed roll is fed, the pleat is positioned to be a position spaced apart with a predetermined distance required for forming a bottom face portion of the packaging body in the feeding direction from the position where the feed roll is cut off in the orthogonal direction to the direction in which the feed roll is fed upon the pouch is manufactured, and a cut-off portion is formed on a portion where the pleat and the rib formed in a pinch form by adhering inner faces of end edges of the packaging material cross.

According to an embodiment of the present invention, there is provided a method of manufacturing the pleated stand-up packaging body comprises intermittently or continuously conveying the feed roll by a former, forming a packaging tube by heat sealing both end edges of the feed roll shaped to be tubular in a pinch form, intermittently or continuously conveying the packaging tube, feeding the product to be packaged by a conveyor into the packaging tube formed inside the former so as to be positioned between the pleats, doubly heat sealing the packaging tube at a position between the products to be packaged downstream of the former, and cutting the packaging tube at a position between the double heat seals.

According to a preferred configuration, the method comprises intermittently or continuously conveying the feed roll, forming the feed roll to be tubular by engaging the feed roll with the former to wind it around a product filling tube arranged inside the former, forming the packaging tube by heat sealing both end edges of the tubular feed roll in a pinch form, falling a product to be packaged through the product filling tube from above, doubly heat sealing the packaging tube at a downstream position between adjacent products by a double heat sealer, cutting the packaging tube at a position between the double heat seals.

According to a preferred configuration, the method comprises resting the packaging body on a first conveyor after it is cut off, conveying the cut off packaging body on a second conveyor disposed to be orthogonal to the first conveyor, intermittently conveying the cut off packaging body while its upper portion is held by a guide rail, and forming the bottom portion by pressing the bottom portion of the packaging body by a pushing plate from the bottom portion side so as not to contact the pleat.

According to a preferred configuration, the method comprises cutting the packaging body, and forming the bottom portion by pressing the bottom portion by the pushing plate from the bottom side of the packaging body fixed to the heat seal portion so as not to contact the pleat after the packaging body positioned downstream is cut off, and the pushing plate is fixed to a tip end of a rotatable arm a terminal end of which is axially fixed.

According to a preferred configuration, the method comprises resting the packaging body on a first conveyor after it is cut off, conveying the cut off packaging body on a second conveyor disposed to be orthogonal to the first conveyor, intermittently or continuously conveying the cut off packaging body while pressing its upper portion by an upper guide rail disposed above the second conveyor in the feeding direction, and forming a bottom portion by pressing the bottom position of the conveyed packaging body by extending a pressing member to a position where the bottom portion of the packaging body is pressed in the direction in which the second conveyor is moved. According to a preferred configuration, the pushing plate or the pressing member comprises a heater.

Effect of the Present Invention

According to the pleated stand-up packaging material of the present invention, the heat seal property on the cross portion where the rib and the pleat cross at a right angle can be improved by forming a cut-off portion with a predetermined size on the cross portion. In addition, a stability of the pleated stand-up packaging material when it is stood up can be improved, while an esthetic appearance of the pleated stand-up packaging pouch and the pleated stand-up packaging body can be improved, by sharply bending the cross portion where the rib and the pleat cross.

BRIEF DESCRIPTION OF THE DRAWINGS

FIG. 8(*a*) is a partial conceptual view showing a situation in which a pushing plate is arranged before the packaging body is cut off by the pouch filling and packaging apparatus of a vertical type, and FIG. 8(*b*) is a partial conceptual view showing a situation in which a bottom portion of the pleated stand-up packaging body is formed.

FIG. 11(*a*) is a cross sectional view showing the first embodiment, while FIG. 11(*b*) is a cross sectional view showing the conventional example of FIG. 10.

EXPLANATION OF THE REFERENCE NUMBERS

Figure 1:
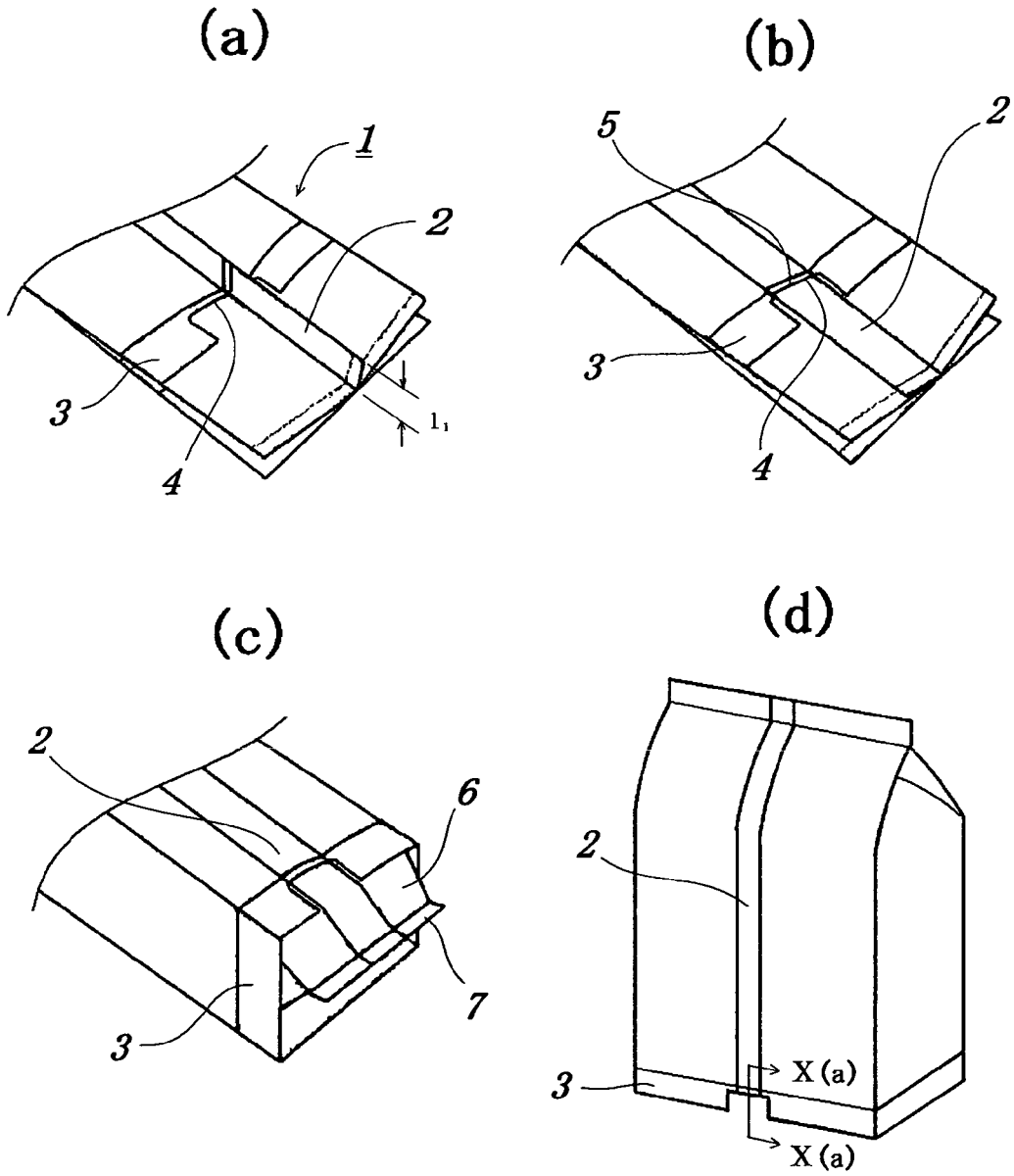
FIG. 1 is a general view showing a packaging pouch and a packaging body of the first embodiment.

1,10, 20: packaging pouch
2,12, 22: rib

3,13, 43, 23: pleat
4,14, 44: cut-off portion
5: cross portion of rib and pleat
30: feed roll

DETAILED DESCRIPTION OF EMBODIMENTS OF THE INVENTION

First Embodiment

FIG. 1 is a partial view showing a packaging pouch of the first embodiment and a perspective view showing a packaging body. As shown in FIG. 1(*a*), a packaging pouch 1 of the first embodiment is formed with a rib 2 in a pinch form by adhering inner faces of its end edges. A pleat 3 is formed around the outer periphery of the packaging pouch 1 by folding it in a three-ply strip form in the orthogonal direction to its longitudinal direction and adhering the inner faces of the folded portions.

A cut-off portion is formed at a portion where the pleat and the rib cross. The width of the cut-off portion is substantially three times as wide as that ($l_1$) of the rib. The width of the cut-off portion is defined to be the one formed by the packaging material before the rib in a pinch form is formed, and thus, it includes a length of the cut-off portion at both sides of the rib 2 (twice as high as the height of the rib).

FIG. 1(*b*) is a view showing a situation where the rib is inclined on this side and the portion 5 where the rib and the pleat cross is heat sealed. When the bottom face portion is folded under this situation, the packaging material 1 is formed into a configuration shown in FIG. 1(*c*). At this stage, an opening portion 7 of the bottom face portion 6 is also hermetically sealed.

After the bottom face portion is folded, the packaging material is formed into a stand-up packaging body shown in FIG. 1(*d*). As shown in FIG. 1(*d*), the cross portion where the rib and the pleat cross can be sharply bent due to the fact that the overlapping portion of the packaging material at the cross section is lessened by forming the cut-off portion on the pleat formed on the edge between the bottom face portion and the outer peripheral portion, whereby the stability and the aesthetic appearance when the packaging material is stood up can be improved.

Figure 11:
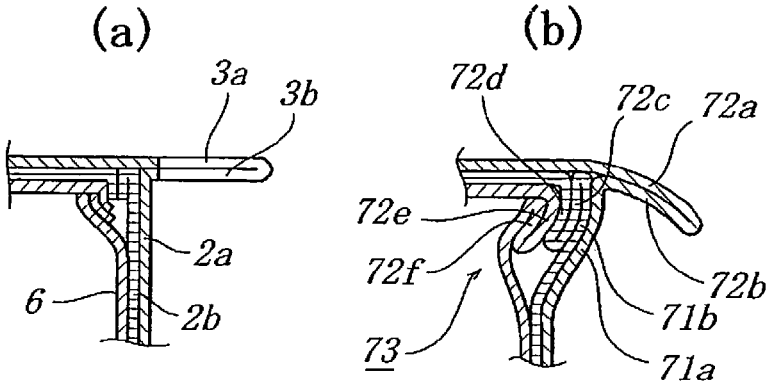
FIG. 11 PRIOR ART
FIG. 11 is a cross sectional view showing a portion where the rib and the pleat cross.

FIG. 11(*a*) is a cross sectional view along X(a)-X(a) in FIG. 1(*d*). As compared with FIG. 11(*b*) showing the conventional example, the packaging material 6 forming the bottom face portion and the ribs 2*a* and 2*b* only exist due to the fact that the overlapping portion of the packaging material is lessened on the portion where the rib and the pleat cross in FIG. 11(*a*). As readily seen from FIG. 11(*a*), the portion where the rib and the pleat cross can be sharply bent due to the fact that the pleats 3*a*, 3*b* are arranged to be orthogonal to the ribs 2*a*, 2*b*, whereby the stability when the pleated stand-up packaging material is stood up can be improved, while the pleated stand-up packaging pouch with a good aesthetic appearance can be provided.

Second Embodiment

Figure 2:
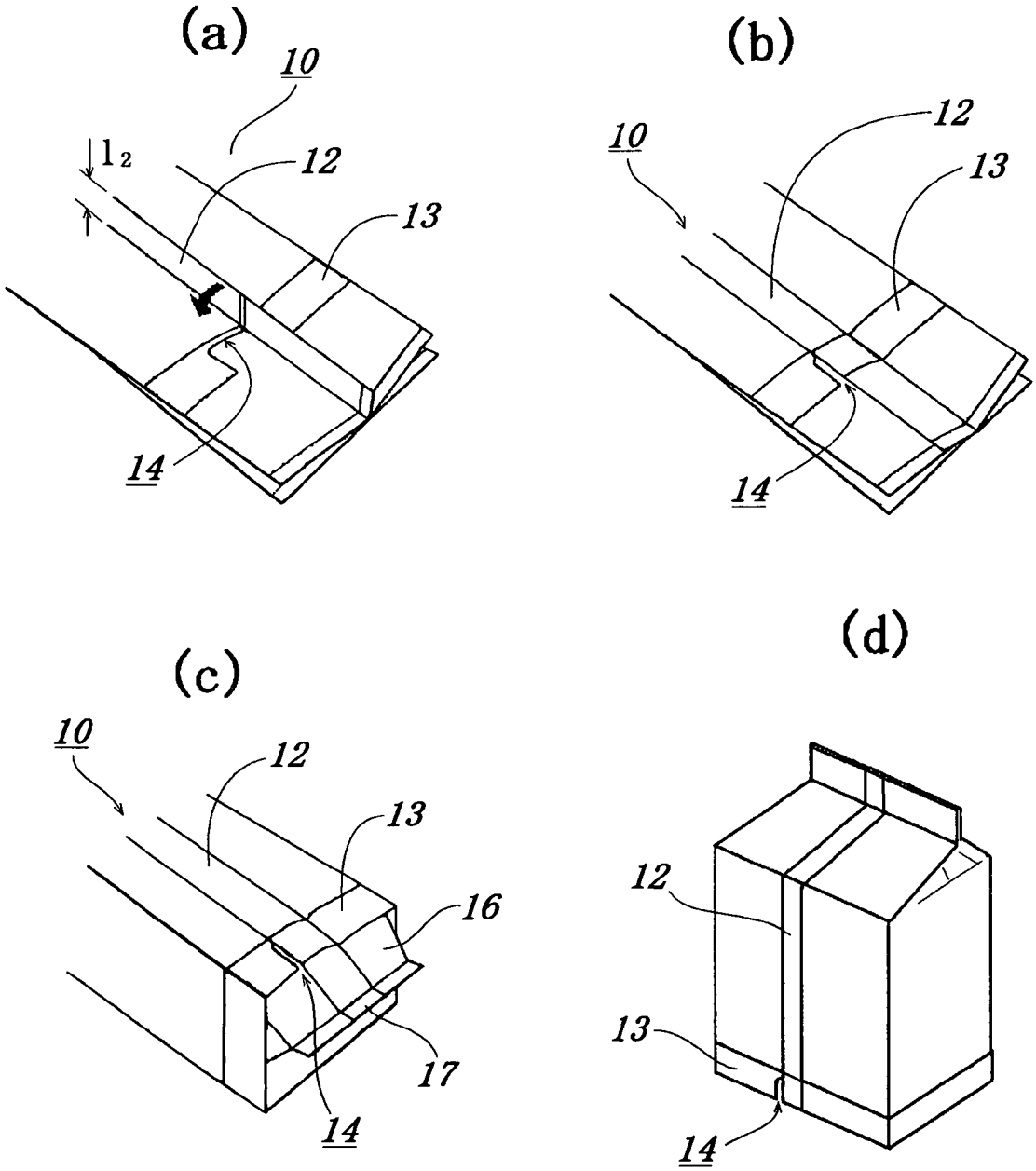
FIG. 2 is a general view showing a packaging pouch and a packaging body of the second embodiment.

FIG. 2 is a partial perspective view showing the packaging pouch of the second embodiment and a perspective view showing the packaging body. As shown in FIG. 2(*a*), the packaging pouch 10 of the second embodiment is formed with a rib 12 in a pinch form by adhering inner faces at end edges. A pleat 13 is formed around the outer periphery of the packaging pouch 10 by folding it in a three-ply strip form in the orthogonal direction to its longitudinal direction and adhering the inner faces of the folded portions.

A cut-off portion 14 is formed at a portion where the pleat 13 and the rib 12 cross. The width of the cut-off portion 14 is substantially two times as wide as that ($l_2$) of the rib. The width of the cut-off portion is defined to be the one formed by the packaging material before the rib in a pinch form is formed. The cut-off portion in the second embodiment corresponds to the one side of the rib 12, or the portion where the rib 12 is inclined. The heat seal property on the cross portion where the rib and the pleat cross at a right angle can be improved, since the heat sealer can be directly applied on the one side of the rib in a case where the rib 12 is formed, by forming the cut-off portion with such a width.

FIG. 2(*b*) is a view showing a situation in which the rib 12 is inclined on this side. When the bottom face portion is folded under this situation, the packaging material is formed into a configuration shown in FIG. 2(*c*). At this stage, an opening portion 17 of the bottom face portion 16 is also hermetically sealed.

After the bottom face portion 16 is folded, the packaging material is formed into a stand-up packaging body shown in FIG. 2(*d*). As shown in FIG. 2(*d*), the cut-off portion is formed on the pleat formed on the edge between the bottom face portion and the outer peripheral portion. Most of the cut-off portion is concealed from outside by the rib 12. Since the overlapping portions of the packaging material on the cross portion where the rib and the pleat cross can be lessened, the cross portion can be sharply bent, whereby the stability and the aesthetic appearance when the pleated stand-up packaging material is stood up can be improved.

Third Embodiment

Figure 3:
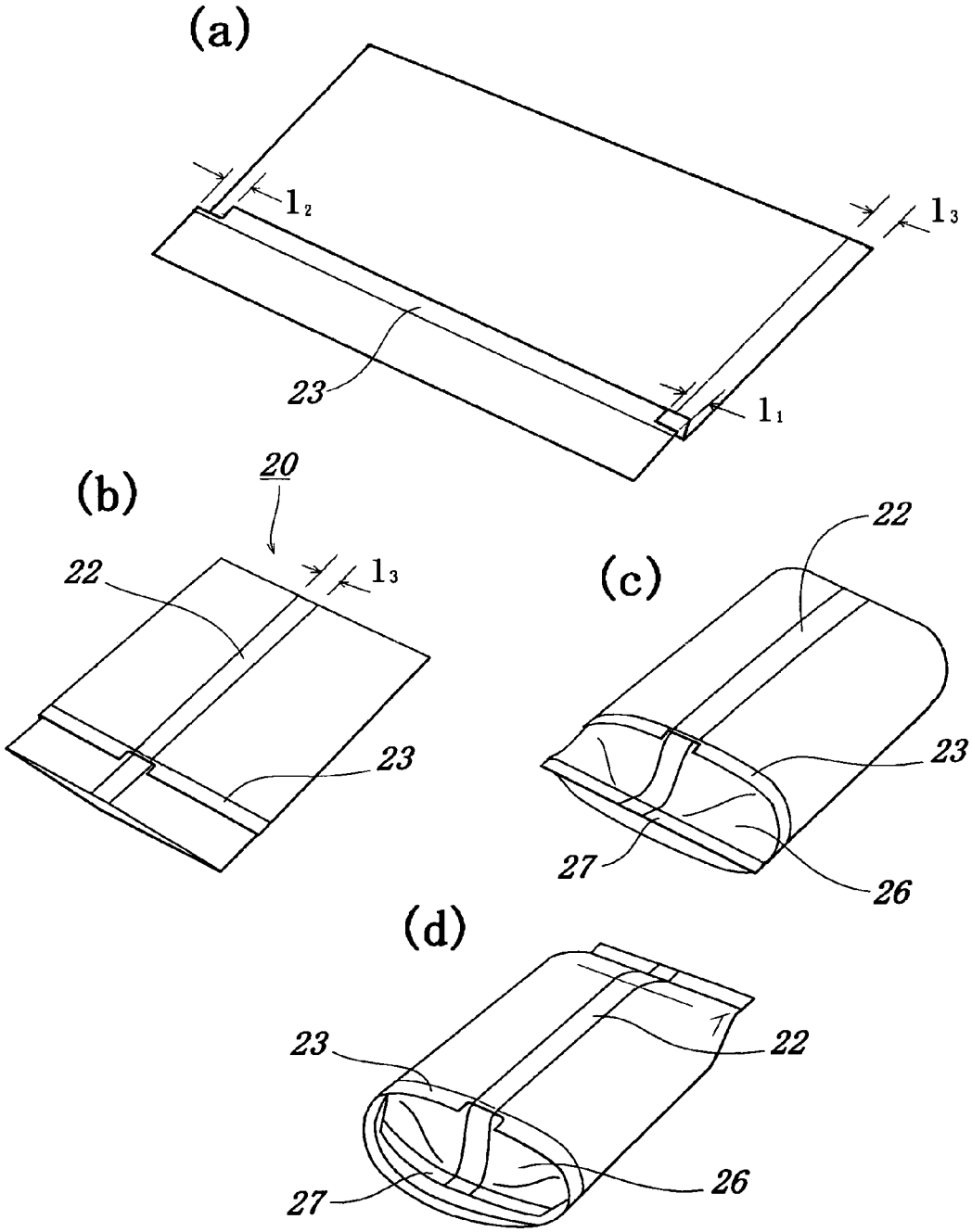
FIG. 3 is a general view showing a packaging pouch and a packaging body of the third embodiment.

FIG. 3 is a partial perspective view showing a packaging pouch of the third embodiment and a perspective view of the packaging body. FIG. 3(*a*) shows the packaging material when the packaging pouch 20 of the third embodiment is manufactured. The width ($l_1$+$l_2$) of the cut-off portion is three times as wide as that ($l_3$) of the portion where the heat seal is applied for forming the rib.

As shown in FIG. 3(*b*), a rib 22 in a pinch form is formed by adhering the inner faces of the end edges of the packaging material. A pleat 23 is formed around the outer periphery of the packaging material 20 by folding the packaging material 20 in a three-ply strip form in the orthogonal direction to its longitudinal direction and adhering the inner faces of the folded portions.

FIG. 3(*c*) shows a situation in which the bottom face portion is folded. At this stage, an opening portion 27 of the bottom face portion 26 is also hermetically sealed.

FIG. 3(*d*) is a perspective view showing the packaging body of the third embodiment seen from the bottom face portion. The packaging body of the third embodiment has no corners on the bottom face portion, but has a ship-shaped figure on the bottom face portion. As shown in FIG. 3(*d*), since the overlapping portion of the packaging material on the cross portion can be lessened due to the fact that the cut-off portion is formed on the pleat formed on the edge between the bottom face portion and the outer peripheral portion, the cross portion can be sharply bent, whereby the stability and the aesthetic appearance when the pleated stand-up packaging material is stood up can be improved.

Fourth Embodiment

Figure 4:
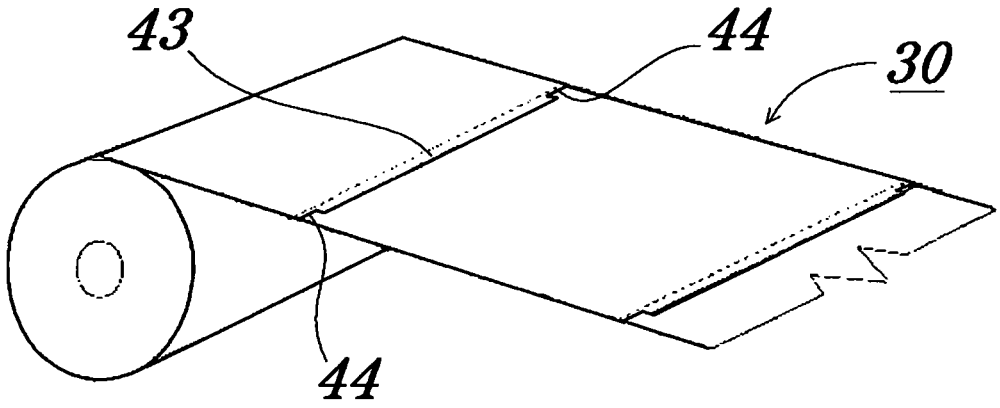
FIG. 4 is a perspective view showing one configuration of a feed roll of the present invention.

FIG. 4 is a perspective view showing one example of a feed roll of the present invention. In a method of manufacturing the feed roll, the feed roll of the packaging material whose inner layer constituting a pouch inner surface comprises a sealant film, laminated OPP and CPP, for example, is mounted on an unwinder, and then, the pleats 43 are formed by passing the packaging material through a pleat forming machine and folding it in a three-ply strip form and adhering inner faces of the folded portion. The pleats 43 are formed being spaced apart from each other at a predetermined distance. The cut-off portions 44,44 are formed by cutting both ends of the pleat. Then, the packaging material is passed through a first guide roll, a second stepped roll, and a second guide roll, and then, is wound around a core mounted on a winder.

Fifth Embodiment

A method of manufacturing the pleated stand-up packaging body of the present invention will be described with reference to FIG. 5. This embodiment is a mere example of the method of manufacturing the pleated stand-up packaging body of the present invention, it does not limit the present invention.

Figure 5:
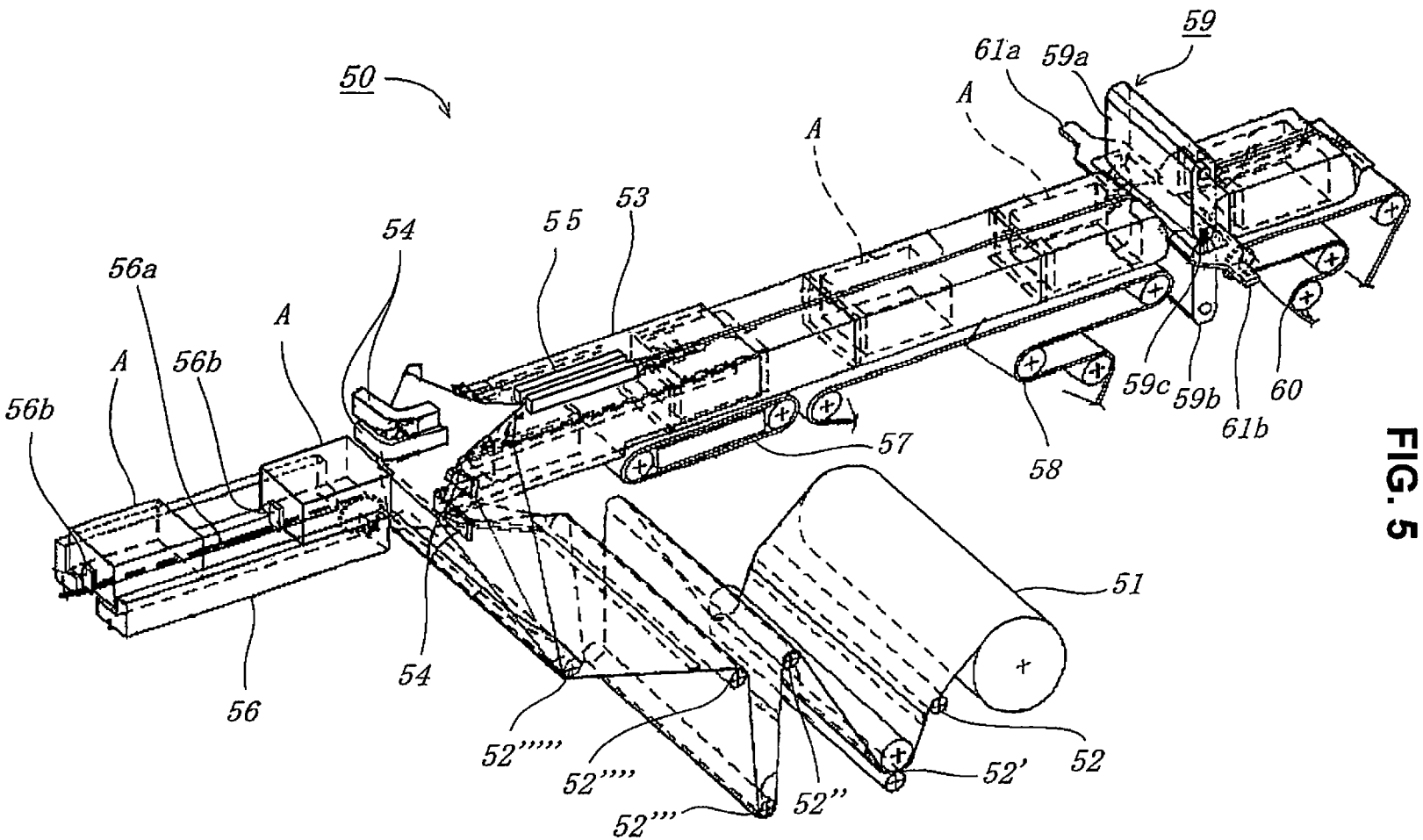
FIG. 5 is a general perspective view showing a pouch filling and packaging apparatus of a horizontal type manufacturing a pleated stand-up packaging body.

FIG. 5 is a general perspective view showing a packaging pouch filling apparatus of a horizontal type which manufactures pleated stand-up packaging bodies.

In FIG. 5, a feed roll is a feed roll 51 for pleated packaging material at least the inner face of which includes a heat seal property and in which pleats extending in a strip form in the orthogonal direction to the feeding direction are formed so as to be spaced apart from each other at a predetermined distance. The pleat is provided in such a way that the inner faces of the packaging material are folded in a pinch form, and then heat sealed to be inclined downstream in the feeding direction. In addition, the pleat is provided at a position spaced apart in the feeding direction from the position where it is to be cut in the orthogonal direction to the feeding direction upon the manufacturing of the pouch with a predetermined distance required for forming the bottom face portion. The cut-off portion is formed on both ends of the pleats, the cut-off width of which includes a length about three times as wide as the width of the rib.

The pleated packaging material fed from the fed roll 51 is engaged by a guide roll 52, and then, is passed through between a packaging material feeding roll 52' driven by a servo motor (not shown) and a rotatable nip roll, and then, engaged by a guide roll 52", a stepped roll 52''', a guide roll 52'''', and a wind correction roll 52'''''.

The stepped roll 52'''serves to maintain the feeding resistance against the feeding of the pleated packaging material to be low and constant. The packaging material feeding roll 52' is rotated by a servo motor so as to decrease an amount of the feeding of the film when the stepped roll 52''' is descended to the lower-most position, while to increase such an amount when the stepped roll 52''' is ascended to the upper-most position.

Then, the pleated packaging material engaged by the wind correction roll 52 is engaged by a former 53 with a C-shaped cross section whose upper portion is opened so as to cover the former 53 from below. The pleated packaging material is folded toward the inner face side of the former 53 at an entrance of the former 53 due to the fact that guide members 54,54 press it, and then, is moved so as not to be disengaged by the inner face of the former 53, followed by the fact that its both end edges are folded in a pinch form, and then, the inner faces are heat sealed by the heat sealer 55 to form the rib, whereby a packaging tube is formed.

The pitch between the adjacent pleats basically corresponds to a length the same as the summation of the height of the pouch, the length from the pleat to the bottom face portion (preferably the length the same as that for folding the side gusset), and the length required for heat sealing the bottom face portion.

A feeding conveyor 56 upstream of the former 53 includes a conveying claws 56*b* provided on an endless chain 56*a* with a constant pitch each of which pushes a product to be packaged fed on a lane table 56*c* so as to feed said product from an entrance of the former 53 into the packaging tube formed inside the former 53.

Then, the packaging tube formed at the former 53 is moved while it is sucked by a belt conveyor with a vacuum function provided on the lower one of the halves constituting the downstream part of the former 53. Then, the packaging tube is conveyed by a shuttle conveyor 58, and then, it is conveyed by a shuttle conveyor 60 provided downstream of an end seal cutter 59 of a box motion type. The end seal cutters 59*a*, 59 *b* are adapted to move toward each other while they are synchronized with the conveyance of the packaging tube so as to be positioned between the products to be packaged.

The shuttle conveyor structure of the conveyors 58, 60 corresponds to the box motion type of the end seal cutter 59. When the lower heat sealer 59*b* is ascended, a space is adjusted in accordance with the movement of the heat sealer 59*b*, while on the other hand, when the lower heat sealer 59*b* is descended after the end seal cut is completed, said space is closed. In this connection, the end seal cutter may be a rotatable heat seal cutter type.

A pair of claws 61*a*, 61*b* are provided for forming a gusset being associated with the end seal cutter 59. In a case where the double heat seal is applied to the packaging tube, before the heat sealers 59*a*, 59*b* are closed, the pair of claws 61*a*, 61*b* are adapted to be stuck into both sides of the packaging tube at the intermediate level of the height of the packaging tube to form a gusset.

Sixth Embodiment

Figure 6:
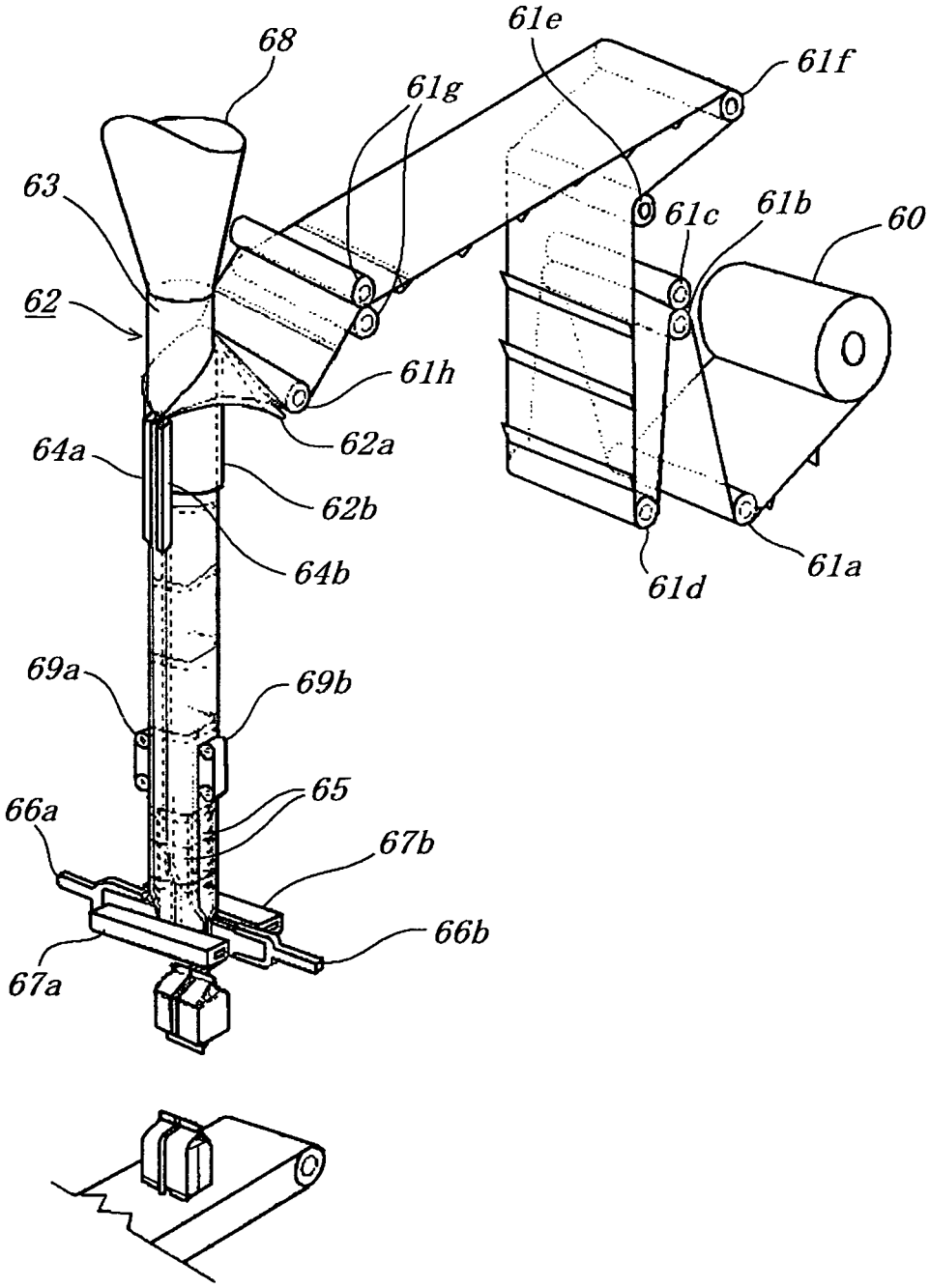
FIG. 6 is a general perspective view showing a pouch filling and packaging apparatus of a vertical type manufacturing a pleated stand-up packaging body.

FIG. 6 is a general perspective view showing the packaging pouch filling apparatus 60 of the vertical type.

As shown in FIG. 6, the packaging material fed from the feed roll 60 is engaged by a guide roll 61*a*, and then, is towed by a feeding roll 61*b* the feeding speed of which is controlled by a servo motor (not shown) and a rotatable nip roll 61*c*, and then, is engaged by a stepped roll 61*d* and guide rolls 61*e*, 61*f*.

The stepped roll 61*d* serves to maintain the feeding resistance against the feeding of the packaging material to be low and constant. The feeding roll 61*b* serves to decrease an amount of the feeding of the film when the stepped roll 61*d* is descended to the lower most position, while to increase such an amount when the stepped roll 61*d* is ascended to the upper most position.

Then, the packaging material is engaged by guide rolls 61*g*, 61*h* and by a sleeve portion 62*a* of the former 62 to pass through a space between a tube portion 62*b* with a C-shaped cross section the front side of which is opened, and a product filling tube 63 extending inside the tube portion 62*a* to be wound once around the product filling tube 63, whereby the end edges of the packaging material is caused to face in a pinch form. At this stage, the packaging tube is formed by gripping the packaging material from its both sides by means of the heat sealers 64*a*, 64*b* to heat seal the ends of the packaging material in a pinch form.

Then, the packaging tube is suspended below the product filling tube 63 to be guided by four guides peripherally disposed inside the packaging tube and suspended from the lower end of the product filling tube 63, so that the shape of the tube is maintained to be rectangular. A top gusset is formed by the fact that an intermediate position of the width of the packaging tube on the right and left sides is stuck by a pair of bars 66*a*, 66*b* for forming a bottom gusset whose tip portion has a bifurcated portion, and then, the packaging tube is heat sealed and cut off and folded toward the inside of the top heat seal. A bottom gusset is formed by the fact that the packaging tube is folded toward inside of the bottom heat seal. Then, the packaging tube is doubly heat sealed by lateral heat sealers 67*a*, 67*b* (the top heat seal and the bottom heat seal), while the packaging tube is cut off at the position between the double heat seal portions by a cutter (not shown) incorporated into one of lateral heat sealers.

While the packaging tube is doubly heat sealed by the lateral heat sealers 67*a*,67*b*, a certain numbers of products to be packaged are introduced into a hopper 68 to pass through the inside of the product filling tube 63 to fall down to the position above the lateral heat sealers 67*a*, 67*b*. When the lateral heat sealers 67*a*, 67*b* are opened, the film is fed by belts 69*a*, 69*b* for feeding films. The packaging body is completed by the fact that the product being filled therewith through the above steps.

Seventh Embodiment

Figure 7:
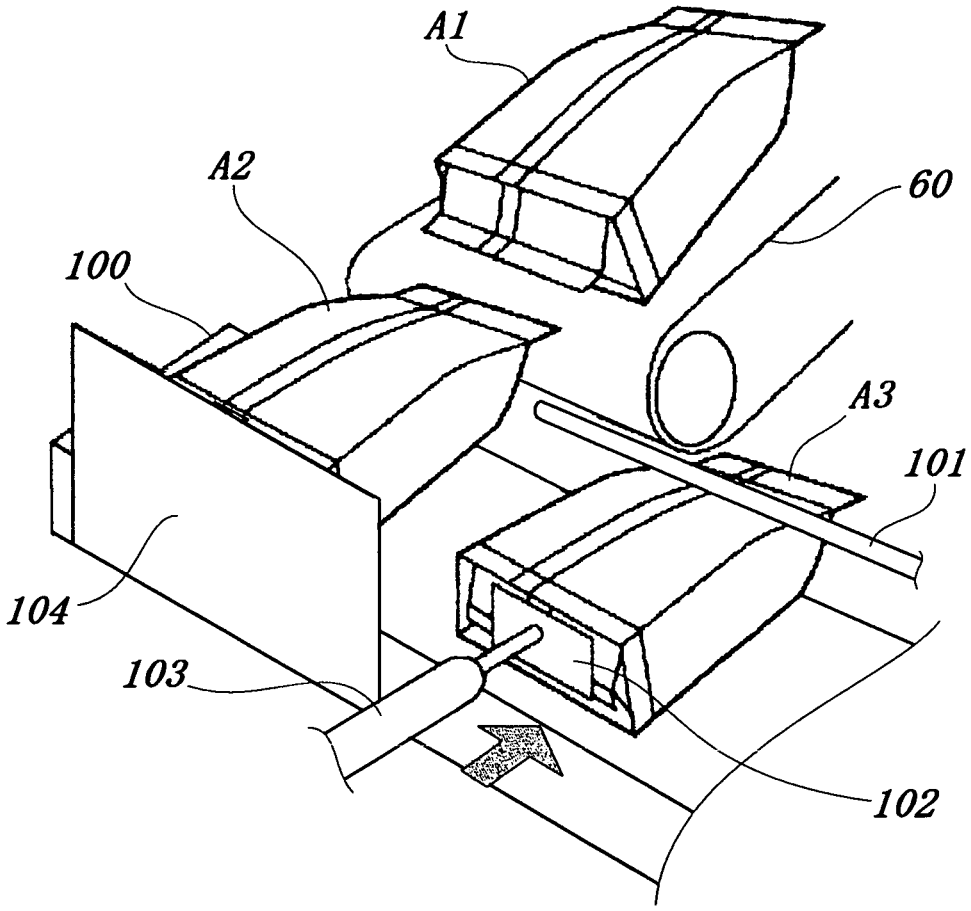
FIG. 7 is a partial conceptual view showing mechanical elements for forming a bottom portion of a pleated stand-up packaging body.

FIG. 7 is a partial conceptual view showing mechanical elements for forming the bottom portion of the pleated stand-up packaging body arranged after it is cut off by the filling and packaging apparatus of the horizontal type.

The packaging body which is cut off by the filling and packaging apparatus of the horizontal type of the fifth embodiment is conveyed by a shuttle conveyor 60. The packaging body A1 conveyed by the shuttle conveyor 60 to a conveyer 100 disposed orthogonal to the shuttle conveyor 60 as the packaging body A2. At this stage, the conveyor 100 is positioned to be below the shuttle conveyor 60, so that the packaging body A2 abuts against a stop plate 104, and then, is intermittently transported while the upper portion of the packaging body A3 is held by a guide rail 101. The packaging body is stopped at the position where a pushing plate 102 is disposed. In the pushing plate 102, a cylinder 103 is adapted to extend toward the bottom portion of the packaging body. At this stage, it is important that the area of the upper surface and the position of the pushing plate 102 are determined in such a way that the pushing plate 102 does not contact pleats formed around an outer periphery of the bottom portion of the packaging body. The pushing plate 102 can function to form the bottom portion of the packaging body by pressing the bottom portion of the packaging body A3.

By the above steps, the portion where the rib and the pleat cross can be sharply bent, while the stability of the pleated stand-up packaging material when it is stood up can be improved, and the aesthetic appearance of the pleated stand-up packaging body can be improved.

Eighth Embodiment

Figure 8:
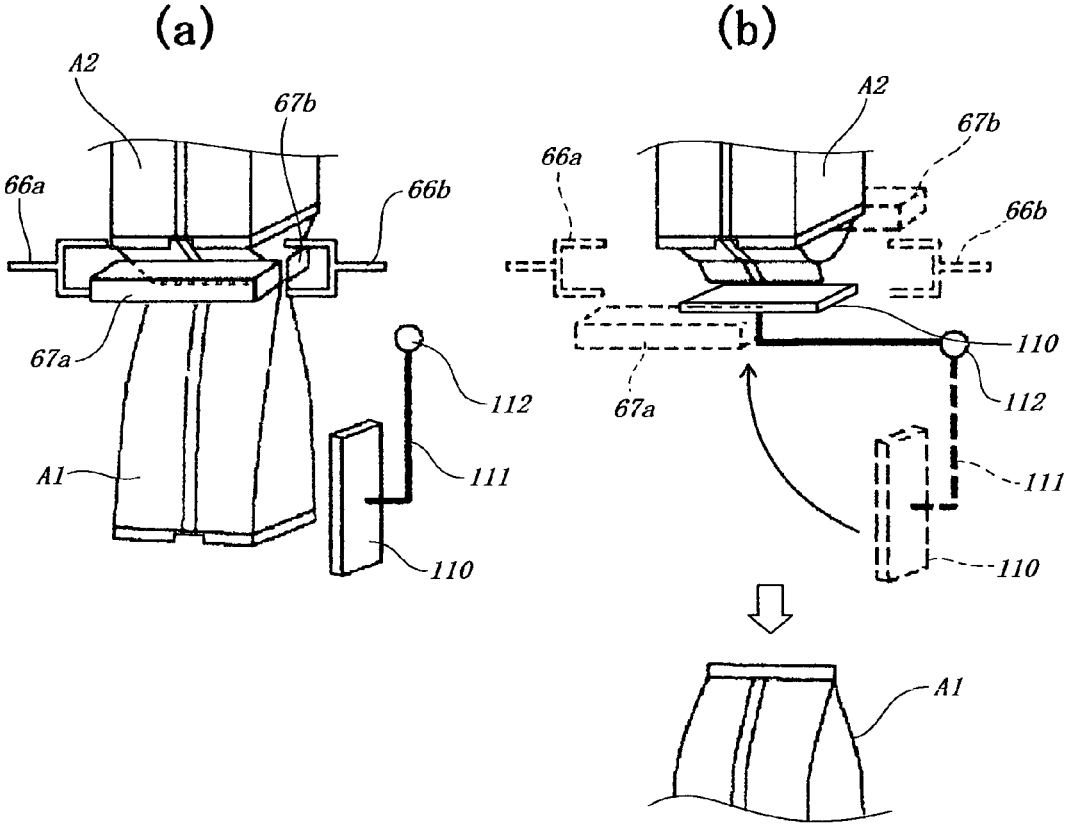
FIG. 8 is a partial conceptual view showing mechanical elements for forming a bottom portion of a pleated stand-up packaging body.

FIG. 8 is a partial conceptual view showing mechanical elements for forming the bottom portion of the pleated stand-up packaging body arranged after it is cut off by the filling and packaging apparatus of the vertical type.

FIG. 8(*a*) is a partial conceptual view showing a situation of a pushing plate 110 before the packaging body is cut off by the filling and packaging apparatus of the vertical type, while FIG. 8(*b*) is a partial conceptual view showing an operation in which a bottom portion of the pleated stand-up packaging body is formed.

In the filling and packaging apparatus of the vertical type of the sixth embodiment, a pair of bars 66*a*, 66*b* for forming a bottom gusset are stuck into an opening side portion between the packaging bodies A1 and A2, and then, the packaging body is doubly heat sealed by lateral heat sealers 67*a*, 67*b*, followed by the fact that a portion between the double heat seal portions is cut off by a cutter (not shown) incorporated into one of the lateral heat sealers. At this stage, the pushing plate 110 is disposed to be side of the packaging body A1. The pushing plate 110 is fixed to a tip end of a rotatable arm 111 whose terminal end is fixed to a hinge 112.

The cut off packaging body A1 is caused to fall down, as shown in FIG. 8(*b*). Then, the bottom portion is formed by the fact that the pushing plate 110 fixed to the arm 111 is rotated to the bottom portion side of the packaging body A2 fixed to the heat seal portion by the axial movement of the hinge 112, and then, pressing the bottom portion of the packaging body A2.

By the above steps, the portion where the rib and the pleat cross can be sharply bent, while the stability of the pleated stand-up packaging material when it is stood up can be improved, and the aesthetic appearance of the pleated stand-up packaging body can be improved.

Ninth Embodiment

Figure 9:
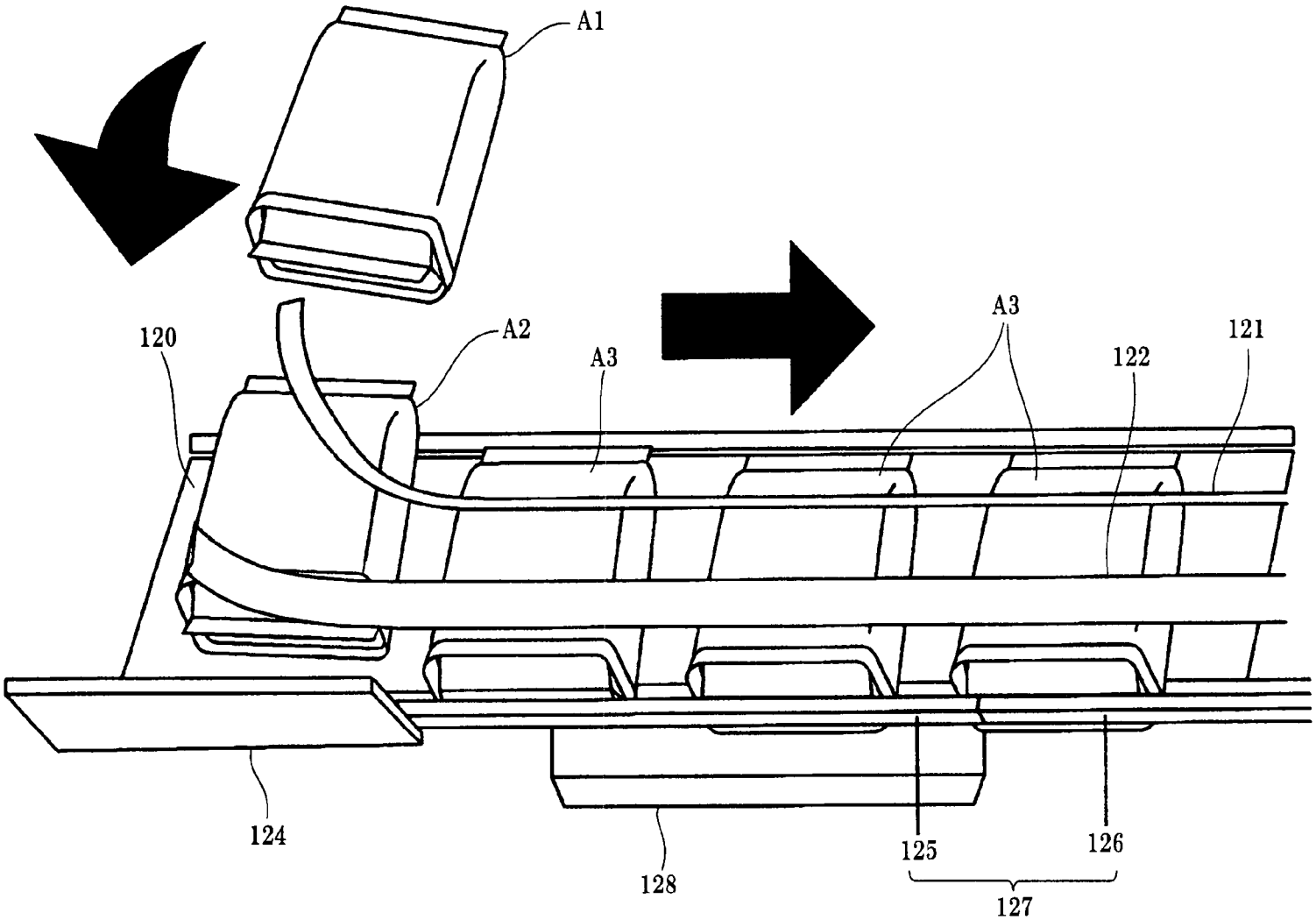
FIG. 9 is a partial conceptual view showing mechanical elements for forming a bottom portion of a pleated stand-up packaging body.
Figure 10:
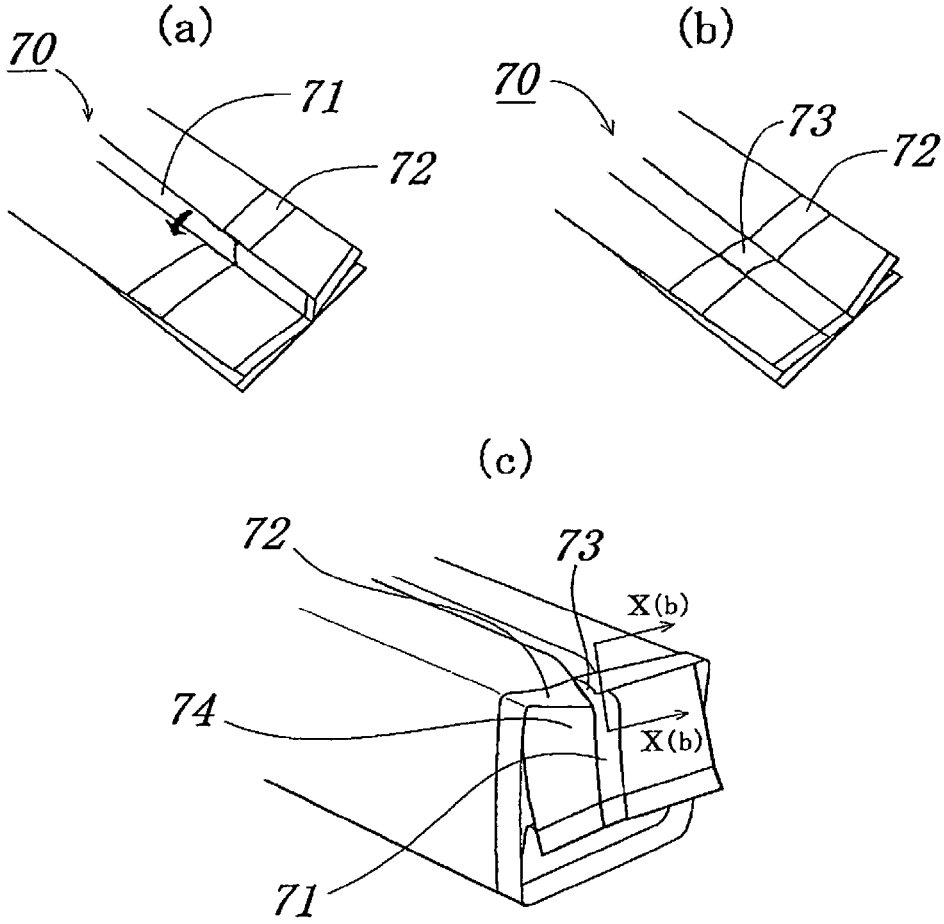
FIG. 10 PRIOR ART
FIG. 10 is a view showing a conventional example.

FIG. 9 is a partial conceptual view showing mechanical elements for forming the bottom portion of the pleated stand-up packaging body arranged after it is cut off by the filling and packaging apparatus of the horizontal type.

The packaging body A1 cut off by the filling and packaging apparatus of the horizontal type of the fifth embodiment is conveyed by a shuttle conveyor (not shown).

The packaging body A1 conveyed by the shuttle conveyor is conveyed to a conveyor 120 disposed orthogonal to the shuttle conveyor as the packaging body A2. At this stage, the conveyor 120 is disposed to be below the shuttle conveyor, and the conveyed packaging body A2 is caused to abut against a stop plate 124, and then, is intermittently or continuously conveyed while it is pressed by upper guide rails 121,122 disposed to be above the conveyed packaging body A3.

The upper guide rails 121,122 are disposed to be above and orthogonal to the conveyor 120 and downstream with respect to the conveyor 120. Two upper guide rails 121,122 are provided in the ninth embodiment, however, only one guide rail 121 which presses the upper portion of the packaging body A3 may be provided. A pressing member 127 are disposed to abut against the bottom portion of the conveyed packaging body A3. The pressing member 127 comprises a heating plate 125 heated by a heater 128, and a cooling bar 126 connected to the heating plate 125. The bottom portion of the packaging body A3 is formed by pressing the bottom portion of the conveyed packaging body by the heating plate 125.

What is claimed is:

1. A method of manufacturing pleated stand-up packaging bodies, the method comprising: intermittently or continuously conveying a feed roll of a packaging material comprising at least one surface having a heat seal property and pleats formed on a surface opposite to the surface having the heat seal property by folding the packaging material in a three-ply strip form in the orthogonal direction to the direction in which the feed roll is fed, wherein a pleat is spaced a predetermined distance from where the feed roll is cut off to form a bottom face portion of each of the packaging bodies and has a cut-off portion at a portion where the pleat and a rib form an inclined cross-portion, and wherein the cut-off portion has a width that is at least twice as wide as the width of the rib such that when the rib is inclined the pleat has been cut out at least under the inclined rib at the cross portion; forming a packaging tube by heat sealing both end edges of the feed roll to be tubular with the rib in a pinched form in a former; intermittently or continuously conveying the packaging tube; feeding products to be packaged by a conveyor into the packaging tube formed inside the former between the pleats; double heat sealing the packaging tube downstream of the former at a position between the products; and cutting the packaging tube at a position between the double heat seals.

2. The method of manufacturing pleated stand-up packaging bodies according to claim 1, wherein the method comprising resting the packaging bodies on a first conveyor after they are cut off, conveying the cut off packaging bodies on a second conveyor disposed to be orthogonal to the first conveyor, intermittently conveying the cut off packaging bodies while their upper portion is held by a guide rail, and forming the bottom portion by pressing the bottom portion of the packaging bodies by a pushing plate from the bottom portion side so as not to contact the pleat.

3. The method of manufacturing a pleated stand-up packaging body according to claim 2, wherein the pushing plate or the pressing member comprises a heater.

4. The method of manufacturing a pleated stand-up packaging bodies according to claim 1, the method additionally comprising resting each packaging body on a first conveyor after it is cut off, conveying the cut off packaging body on a second conveyor disposed to be orthogonal to the first conveyor, intermittently or continuously conveying the cut off packaging body while pressing its upper portion by an upper guide rail disposed above the second conveyor in the feeding direction, and forming a bottom portion by pressing the bottom position of the conveyed packaging body by extending a pressing member to a position where the bottom portion of the packaging body is pressed in the direction in which the second conveyor is moved.

5. A method of manufacturing pleated stand-up packaging bodies, the method comprising: intermittently or continuously conveying a feed roll of a packaging material comprising at least one surface having a heat seal property and pleats formed on a surface opposite to the surface having the heat seal property by folding the packaging material in a three-ply strip form in the orthogonal direction to the direction in which the feed roll is fed, wherein a pleat is spaced a predetermined distance from where the feed roll is cut off to form a bottom face portion of each of the packaging bodies and has a cut-off portion at a portion where the pleat and a rib form an inclined cross-portion, and wherein the cut-off portion has a width that is at least twice as wide as the width of the rib such that when the rib is inclined the pleat has been cut out at least under the inclined rib at the cross portion; forming the packaging material into a packaging tube by engaging the packaging material with a former about a product filling tube and heat sealing both end edges of the packaging tube to form the rib in a pinched form; feeding products to be packaged through the product filling tube into the packaging tube from above; double heat sealing the packaging tube downstream of the former at a position between the products; and cutting the packaging tube at a position between the double heat seals.

6. The method of manufacturing pleated stand-up packaging bodies according to claim 5, the method additionally comprising cutting each packaging body, and forming the bottom portion by pressing the bottom portion by a pushing plate from the bottom side of the packaging body fixed to the heat seal portion so as not to contact the pleat after the packaging body positioned downstream is cut off, and the pushing plate is fixed to a tip end of a rotatable arm a terminal end of which is axially fixed.

7. The method of manufacturing a pleated stand-up packaging body according to claim 6, wherein the pushing plate comprises a heater.

8. The method of manufacturing a pleated stand-up packaging body according to claim 4, wherein the pressing member comprises a heater.

9. A pleated stand-up packaging pouch comprising: one rib in a pinched form which is formed by adhering inner faces of both end edges of a packaging material and at least one pleat which is formed by folding the packaging material into a three-ply strip form in an orthogonal direction to its longitudinal direction and adhering inner faces of the folded portions, characterized in that a pleat formed on an edge between a folded bottom face portion and a peripheral portion of the packaging material extends from the peripheral portion in a plane containing the peripheral portion, the bottom face portion and an upper end of an underside face of the pleat substantially forming a right angle and the pleat comprising a cut-off portion at a portion of the packaging material where the rib is inclined and forms a cross portion with the pleat, the cut-off portion having a width that is at least twice as wide as the width of the rib such that when the rib is inclined, the pleat has been cut out at least under the inclined rib at the cross portion.

10. The pleated stand-up packaging pouch according to claim 9, wherein the width of the cut-off portion is equal to, or wider than three times of the width of the rib.

11. A pleated stand-up packaging body which is formed by placing a product in the pleated stand-up packaging pouch according to claim 9, and adhering an opening thereof.

* * * * *